US011624998B2

(12) United States Patent
Seto et al.

(10) Patent No.: US 11,624,998 B2
(45) Date of Patent: Apr. 11, 2023

(54) IMAGE FORMING APPARATUS HAVING PLATES FIXED TO EACH OTHER BY A FASTENER AND WITH ADHESIVE

(71) Applicant: CANON KABUSHIKI KAISHA, Tokyo (JP)

(72) Inventors: Masaki Seto, Shizuoka (JP); Yuji Koseki, Shizuoka (JP); Shigeo Murayama, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/678,876

(22) Filed: Feb. 23, 2022

(65) Prior Publication Data

US 2022/0179353 A1 Jun. 9, 2022

Related U.S. Application Data

(63) Continuation of application No. 17/084,391, filed on Oct. 29, 2020, now Pat. No. 11,281,148.

(30) Foreign Application Priority Data

Nov. 1, 2019 (JP) ..... JP2019-200133

(51) Int. Cl.
*G03G 21/16* (2006.01)

(52) U.S. Cl.
CPC ..... *G03G 21/1619* (2013.01); *G03G 21/1647* (2013.01); *G03G 2221/1678* (2013.01)

(58) Field of Classification Search
CPC ..... G03G 21/16; G03G 21/1619; G03G 21/1647; G03G 2221/16; G03G 2221/1678; H05K 5/02; H05K 5/04; H05K 7/18; B41J 29/00
See application file for complete search history.

(56) References Cited

U.S. PATENT DOCUMENTS 11,281,148 B2 * 3/2022 Seto ..... G03G 21/1619
2020/0192236 A1 * 6/2020 Otoguro ..... G03G 21/16

* cited by examiner

*Primary Examiner* — Sophia S Chen
(74) *Attorney, Agent, or Firm* — Canon U.S.A., Inc. I.P. Division

(57) ABSTRACT

An image forming apparatus includes a frame having a first metal plate and a second metal plate where the first metal plate has a recess portion. The frame supports an image forming member that forms an image on a sheet. The first metal plate and the second metal plate are positioned to each other and an adhesive is in a space formed between the recess portion and the second metal plate. The space is such that it receives the adhesive by injection.

14 Claims, 13 Drawing Sheets

IMAGE FORMING APPARATUS HAVING PLATES FIXED TO EACH OTHER BY A FASTENER AND WITH ADHESIVE

This application is a Continuation of U.S. patent application Ser. No. 17/084,391, filed Oct. 29, 2020, which claims the benefit of Japanese Patent Application No. 2019-200133, filed Nov. 1, 2019, all of which are hereby incorporated by reference herein in their entirety.

BACKGROUND OF THE DISCLOSURE

Field of the Disclosure

The disclosure relates to an image forming apparatus, and more particularly, to a frame (housing) of the image forming apparatus.

Description of the Related Art

In an electrophotographic image forming apparatus, a structure in which metal plates are fastened to each other with screws has been widely used for a frame configured to support an image forming portion configured to perform image formation on a recording material or a conveying portion configured to convey the recording material. When a stiffness of the frame of the image forming apparatus is low, however, various image quality degradations such as image distortion and, in a case of a color image forming apparatus, color misregistration may be caused. Thus, in order to achieve a frame stiffness, which is necessary for the image forming apparatus, the number of positions at which fastening with a screw is performed is increased or a plate thickness of each of the metal plates to be used is increased to improve the stiffness of the frame.

Meanwhile, for example, in Japanese Patent Application Laid-Open No. 2003-98780 and Japanese Patent Application Laid-Open No. 2003-66670, a frame structure of an image forming apparatus, which is formed by coupling a plurality of metal plates by welding or through via adhesive, has been proposed. With the frame structure described above, an inexpensive image forming apparatus with high printing precision and a high stiffness without causing image quality degradation can be provided. In a case of a frame structure obtained by joining and welding, which is proposed in, for example, Japanese Patent Application Laid-Open No. 2003-66670, however, for example, a welding machine for performing welding and a large holding tool corresponding to a frame size, which is configured to hold the frame at the time of welding work, are required. Thus, a large equipment investment is required. In view of such matters, a method using the adhesive for joining between the metal plates, which is proposed in Japanese Patent Application Laid-Open No. 2003-98780, has attracted attention in recent years. The method using the adhesive for joining between the metal plates has attracted attention as a joining method for a metal plate frame for unnecessity of a large equipment investment and excellent weight saving.

When the frame of the image forming apparatus is manufactured by bonding the metal plates via the adhesive, the adhesive is first applied to an assembled surface of one of the metal plates before assembly work so that the adhesive is applied between the metal plates. Then, the one metal plate is assembled to another metal plate. Further, the metal plates are required to be temporarily fixed so as to maintain an assembled state until the adhesive is solidified to completely bond the metal plates to each other to a predetermined degree of bonding. However, each of the metal plates for forming the frame includes a plurality of components. Thus, a cumbersome step of taking and placing aside an application tool is required to be repeatedly performed so as to apply the adhesive. Thus, assembly work efficiency is remarkably lowered to lead to lower productivity.

Further, when time from completion of the above-mentioned work of applying the adhesive to start of work of assembling the one metal plate to the another metal plate is too long, there arises a matter in that the applied adhesive may be solidified to prevent achievement of desired bonding strength. Thus, working time is required to be strictly controlled. Further, in a case of a frame structure that is assembled while one metal plate is being slid against the another metal plate in a plane direction with substantially no gap therebetween, bonded surfaces are rubbed together to achieve the assembly. Thus, there arises a matter in that the adhesive applied in advance may be scraped off at the time of assembly to prevent the achievement of desired bonding strength or the adhesive may be moved in the assembly work to cause the adhesive to adhere to an area for which bonding is not required.

SUMMARY OF THE DISCLOSURE

The disclosure has been made towards providing an image forming apparatus including a frame that is easily and efficiently formed by adhering with an adhesive.

According to an aspect of the present disclosure, an image forming apparatus includes a frame configured to support an image forming member configured to form an image on a sheet, wherein the frame includes a first metal plate and a second metal plate, wherein the first metal plate has a recess portion, and wherein the first metal plate and the second metal plate are positioned to each other and an adhesive is in a space formed between the recess portion and the second metal plate that is configured to receive the adhesive by injection.

Further features of the present disclosure will become apparent from the following description of exemplary embodiments with reference to the attached drawings.

DESCRIPTION OF THE EMBODIMENTS

Now, an embodiment of the disclosure is described in detail with reference to the drawings. Unless otherwise specifically described, for example, dimensions, materials, and relative arrangements of components described below are not intended to limit the scope of the disclosure solely to those described herein.

Embodiment

[Image Forming Apparatus]

Figure 1:
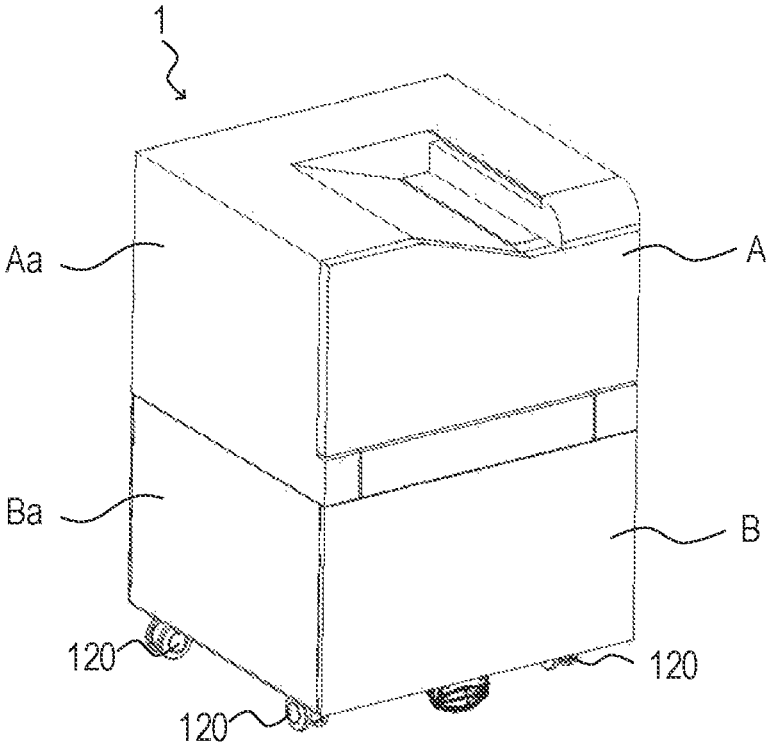
FIG. 1 is a perspective view for illustrating a configuration of an image forming apparatus according to an embodiment.

With reference to FIG. 1, an overall configuration of a laser beam printer 1 corresponding to an electrophotographic image forming apparatus to which the disclosure is applied is described. FIG. 1 is a perspective view for illustrating an outside shape of the laser beam printer 1 as a whole under a state in which a cover Aa being an exterior member is mounted. The laser beam printer 1 includes a main body A and an optional feeding deck B (hereinafter referred to as "feeding deck B") being an optional device. The main body A is an image forming apparatus main body configured to perform image formation on a sheet being a recording material. The main body A includes a sheet cassette 16 (FIG. 2) inside the apparatus. The sheet cassette 16 is a stacking portion in which the sheets are stacked. The feeding deck B is an optional device capable of feeding a large number of sheets, that is, two thousand sheets. The main body A is placed on top of the feeding deck B so as to be located in an upper part of the apparatus, and is coupled to the feeding deck B. Four casters 120 are mounted to a bottom portion of the feeding deck B so that the feeding deck B can be moved under a state of being integrated with the main body A.

[Configuration of Laser Beam Printer]

Figure 2:
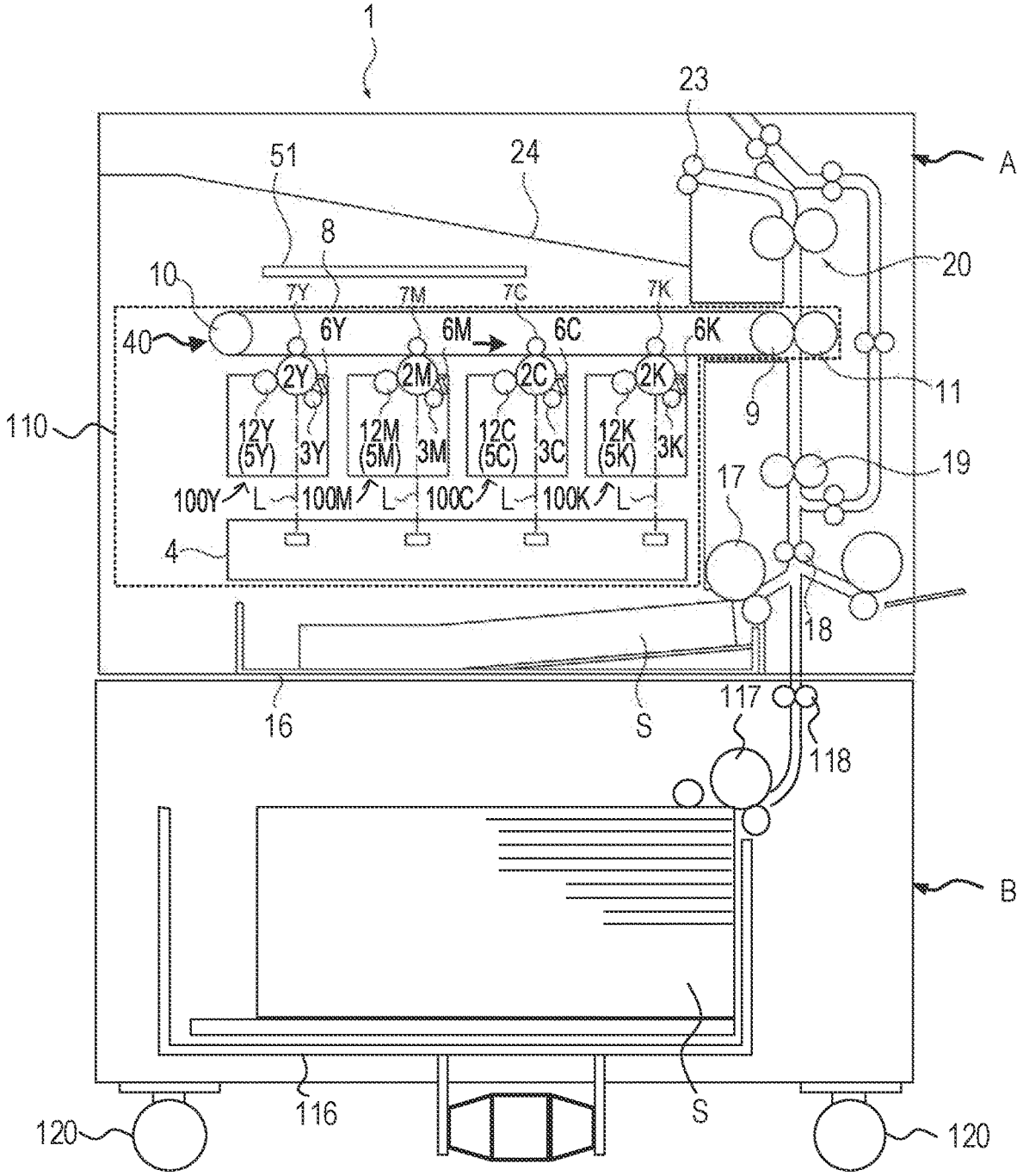
FIG. 2 is a sectional view for illustrating configurations of an image forming apparatus main body and an optional feeding deck according to the embodiment.

The main body A according to the embodiment performs the image formation in the following manner. After toner images formed with toners of four colors being yellow (Y), magenta (M), cyan (C), and black (K) are transferred onto an intermediate transfer belt, the toner images on the intermediate transfer belt are transferred onto a sheet S. As illustrated in FIG. 2, the main body A includes an image forming portion 110, a sheet feeding portion, and a fixing portion 20. The image forming portion 110 is configured to transfer the toner images onto the sheet S to perform the image formation. The sheet feeding portion includes a feed roller 17 configured to feed the sheet S placed in the feeding cassette 16. The fixing portion 20 is configured to fix the toner images onto the sheet S.

The image forming portion 110 includes process cartridges 100 corresponding to the colors of the toners, that is, yellow (Y), magenta (M), cyan (C), and black (K). In FIG. 2, reference symbols for denoting members of the process cartridge 100 of each of the colors include Y (yellow), M (magenta), C (cyan), or K (black), which represents the color of the toner, as the last letter. The process cartridges 100 of the respective colors have the same configuration. In the following description, the last alphabet letters in the reference symbols, that is, Y, M, C, and K are omitted except for a case in which the reference symbol is required to represent a member of a specific color. Each of the process cartridges 100 includes a photosensitive drum 2, a charging roller 3, and a developing device 5. The photosensitive drum 2 is a photosensitive member. The charging roller 3 is configured to charge a surface of the photosensitive drum 2 to a uniform potential. The developing device 5 is configured to develop an electrostatic latent image formed on the surface of the photosensitive drum 2 with the toner to form the toner image. Further, the process cartridge 100 also includes a cleaning blade 6 configured to remove the toner remaining on the surface of the photosensitive drum 2.

Further, the image forming portion 110 includes a laser scanner unit 4, primary transfer rollers 7, and an intermediate transfer unit 40. The laser scanner unit 4 is an exposure portion configured to scan the surface of each of the photosensitive drums 2 to form the electrostatic latent image. The primary transfer rollers 7 are provided so as to be opposed to the photosensitive drums 2 of the process cartridges 100 of the respective colors. The intermediate transfer unit 40 includes an intermediate transfer belt 8, a secondary transfer roller 11, a secondary transfer opposing roller 9, and a tension roller 10. The intermediate transfer belt 8 is an endless belt looped around the secondary transfer opposing roller 9 and the tension roller 10 in a tensioned manner. The intermediate transfer belt 8 is rotated in a direction indicated by the arrow (counterclockwise direction) of FIG. 2, and is nipped between the primary transfer roller 7 and the photosensitive drums 2 to transfer the toner images formed onto the photosensitive drums 2.

Meanwhile, the feeding deck B includes a sheet cassette 116, a feed roller 117, and conveyance rollers 118. A large amount of sheets S as large as two thousand sheets can be stacked in the sheet cassette 116. The feed roller 117 is configured to feed the sheet S stacked in the sheet cassette 116. The conveyance rollers 118 are configured to convey the sheet S fed by the feed roller 117 to the main body A. The main body A is placed on the top of the feeding deck B to allow the feeding deck B to be coupled to the main body A. The casters 120 are mounted to the bottom portion of the feeding deck B so that the feeding deck B can be moved under a state of being integrated with the main body A.

[Image Formation Operation]

Next, an image formation operation including an operation of conveying the sheet S is described. First, when a control portion (not shown) mounted on a printed board 51 of FIG. 2 receives a print job signal for commanding the image formation on the sheet S from an external computer (not shown), the image formation operation described below is started. The sheets S stacked and received in the feed cassette 16 are conveyed to a secondary transfer portion including the secondary transfer roller 11 and the secondary transfer opposing roller 9 by the feed roller 17, conveyance rollers 18, and registration rollers 19.

Meanwhile, in the image forming portion 110, a charging voltage is first applied to the charging rollers 3 to thereby charge the surfaces of the photosensitive drums 2 to a uniform potential. Subsequently, the laser scanner unit 4 radiates laser light L in accordance with image data transmitted from, for example, the external computer (not shown) to the surfaces of the photosensitive drums 2 of the process cartridges 100 of the respective colors to the light to thereby expose the surfaces of the photosensitive drums 2 to the light. As a result of the exposure of the surfaces of the photosensitive drums 2 to the light with the laser scanner unit 4, the electrostatic latent images are formed on the surfaces of the photosensitive drums 2. Then, when a development voltage is applied to developing rollers 12 included in the developing devices 5, the toners of the respective colors are caused to adhere to the electrostatic latent images formed on the surfaces of the photosensitive drums 2 by the laser scanner unit 4 to thereby develop the electrostatic latent images. As a result, the toner images are formed on the surfaces of the photosensitive drums 2, respectively.

Next, when a primary transfer voltage is applied to the primary transfer rollers 7 opposed to the photosensitive drums 2, the toner images formed on the surfaces of the photosensitive drums 2 of the process cartridges 100 are transferred onto the intermediate transfer belt 8 in an overlapped manner. As a result of the transfer of the toner images of the respective colors in an overlapped manner, a full-color toner image is formed on a surface of the intermediate transfer belt 8. The toners remaining on the surfaces of the photosensitive drums 2 without being transferred to the intermediate transfer belt 8 are scraped off by the cleaning blades 6 so as to be removed.

Then, when the intermediate transfer belt 8 is circulated in the direction indicated by the arrow (counterclockwise direction) of FIG. 2, the transferred toner image is sent to the secondary transfer portion. In the secondary transfer portion, when a secondary transfer voltage is applied to the secondary transfer roller 11, the toner image on the intermediate transfer belt 8 is transferred onto the sheet S conveyed from the sheet cassette 16. The sheet S onto which the toner image has been transferred is conveyed to the fixing portion 20 where the sheet S is subjected to a heating and pressurizing process. As a result, the toner image on the sheet S is fixed onto the sheet S. After that, the sheet S onto which the toner image has been fixed is delivered to a delivery portion 24 by delivery rollers 23.

Subsequently, an operation of conveying the sheet S from the feeding deck B is described. When a user sets sheet feeding from the feeding deck B and the control portion (not shown) receives a print job signal, the feed rollers 117 feed the sheet S from the sheet cassette 116 of the feeding deck B. The fed sheet S is conveyed to the main body A by the conveyance rollers 118. The sheet S conveyed to the main body A is conveyed to the secondary transfer portion by the conveyance rollers 18 and the registration rollers 19 in the main body A. The image formation operation performed by the image forming portion 110 is the same as the image formation operation described above, and description thereof is omitted.

[Frame Structure of Main Body and Temporary Assembly of Frame]

Figure 3:
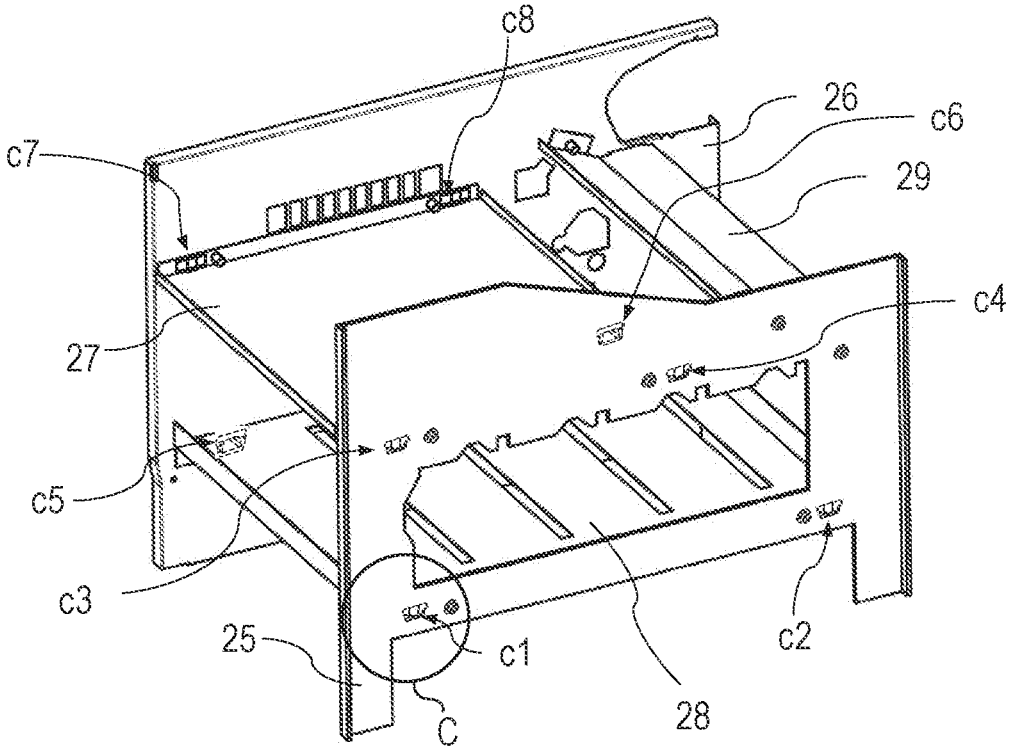
FIG. 3 is a perspective view for illustrating a frame structure of the image forming apparatus main body according to the embodiment.

Next, a frame structure configured to support various image forming members arranged in the main body A is described. FIG. 3 is a perspective view for illustrating a frame (housing) structure of the main body A under a state in which the cover Aa of the main body A placed on the top of the feeding deck B of the laser beam printer 1 illustrated in FIG. 1 and members installed inside the main body A, such as the image forming portion 110, which are illustrated in FIG. 2, are removed. A frame of the main body A includes three stays 27, 28, and 29, a front plate 25, and a rear plate 26. The front plate 25 and the rear plate 26 are configured to support the three stays 27, 28, and 29. As illustrated in FIG. 3, the stays 27 and 28, the front plate 25, and the rear plate 26 are bonded at bonding portions c1 to c8 via an adhesive. More specifically, the bonding portions c1 and c2 are formed so as to bond the stay 28 and the front plate 25 to each other. The bonding portions c3 and c4 are formed so as to bond the stay 27 and the front plate 25 to each other. Meanwhile, the bonding portions c5 and c6 for bonding the stay 28 and the rear plate 26 to each other are formed at positions opposite to the bonding portions c1 and c2 with respect to the stay 28. The bonding portions c7 and c8 for bonding the stay 27 and the rear plate 26 to each other are formed at positions opposite to the bonding portions c3 and c4 with respect to the stay 27.

Figure 4:
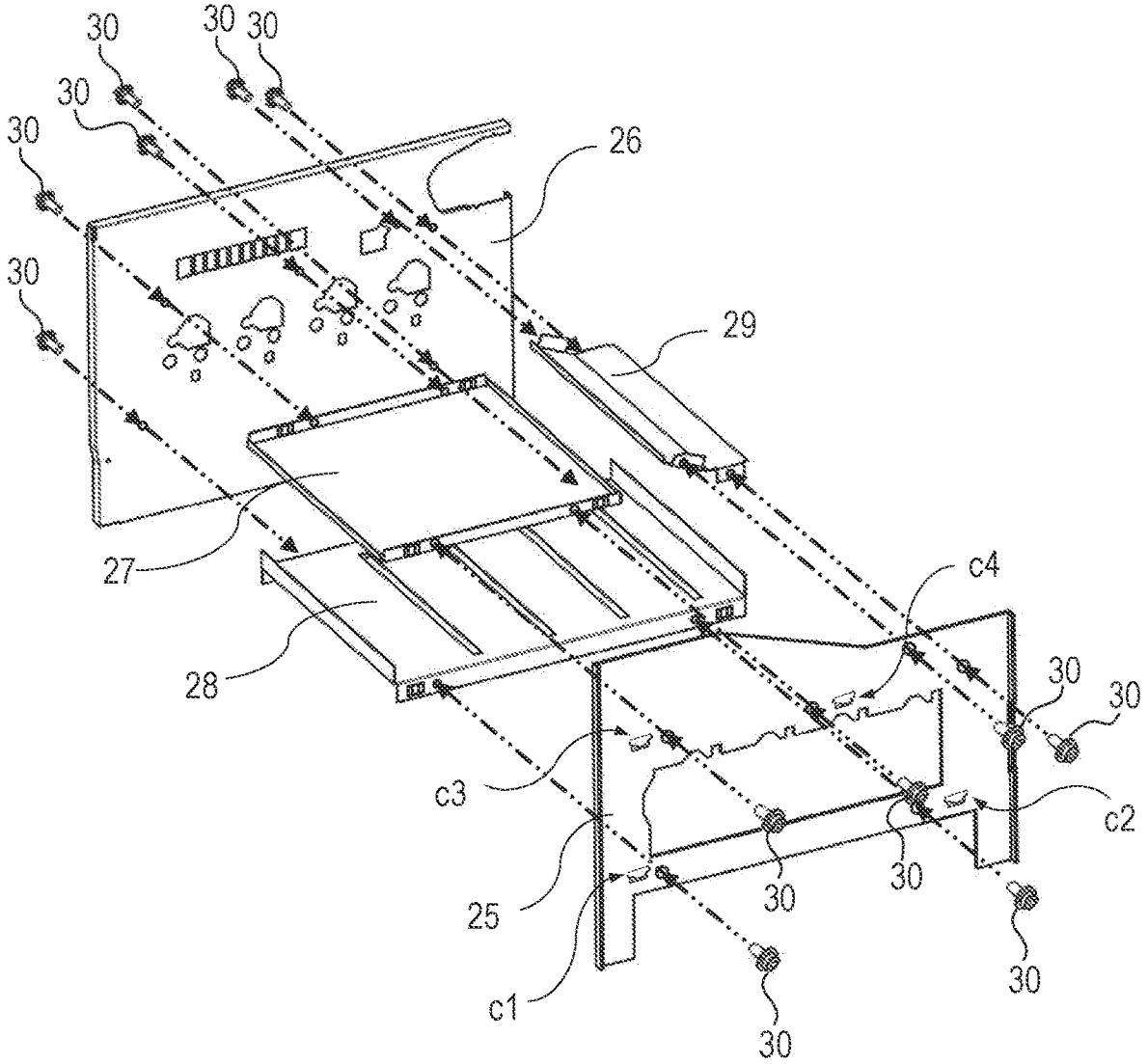
FIG. 4 is an explanatory view for illustrating assembly of a frame of the image forming apparatus main body according to the embodiment.

FIG. 4 is an exploded explanatory view for illustrating a way of assembling the frame of the main body A, which is illustrated in FIG. 3. As illustrated in FIG. 4, for the assembly of the frame of the main body A, the front plate 25 and the rear plate 26 are brought closer to the three stays 27, 28, and 29 placed in the center from a front side and a rear side so as to sandwich and mount the stays 27, 28, and 29 therebetween. The stays 27, 28, and 29, the front plate 25, and the rear plate 26 are fastened together with screws 30 in a front-and-rear direction to be temporarily assembled. More specifically, at the time of the assembly, the stays 27, 28, and 29 are placed on a frame assembly tool (not shown), which is an auxiliary tool, to be supported on the frame assembly tool. Then, when the front plate 25 and the rear plate 26 are assembled, the fastening with the screws 30 (also referred to as "screwing"), which are fixing units configured to fix the metal plates, is performed under a state in which the front plate 25 and the rear plate 26 are positioned with respect to the stays 27, 28, and 29, which are placed on the frame assembly tool. In this manner, the front plate 25 and the rear plate 26 can be assembled to the stays 27, 28, and 29 with high precision. After the completion of screw tightening, the frame assembly tool, which has supported the stays 27, 28, and 29, is removed. Then, the adhesive is injected between the stays 27 and 28, and the front plate 25 and the rear plate 26 in the frame that has been fastened with the screws 30 and temporarily assembled. After the adhesive is solidified, the bonding portions c1 to c8 are formed. As a result, the stays 27 and 28, the front plate 25, and the rear plate 26 are firmly joined to each other to terminate the assembly of the frame.

Figure 5A:
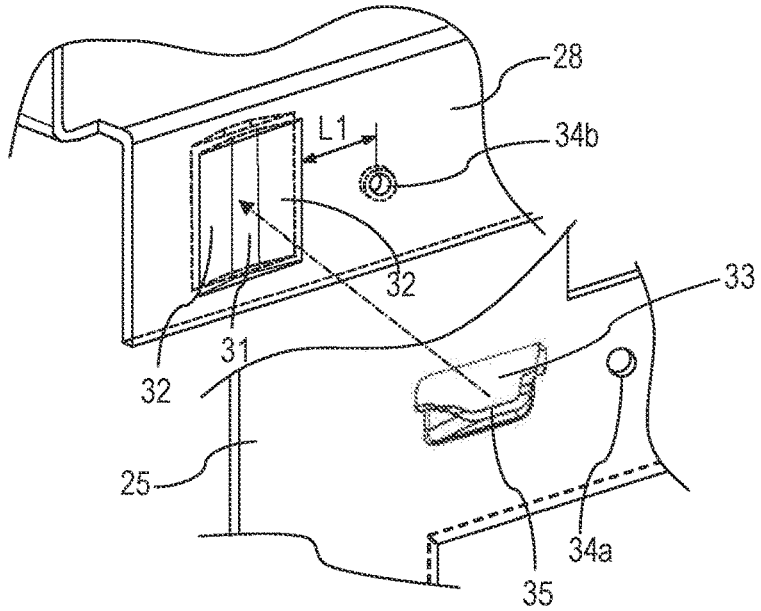
FIG. 5A, FIG. 5B, and FIG. 5C are explanatory views for illustrating the assembly of the frame of the image forming apparatus main body according to the embodiment.
Figure 5B:
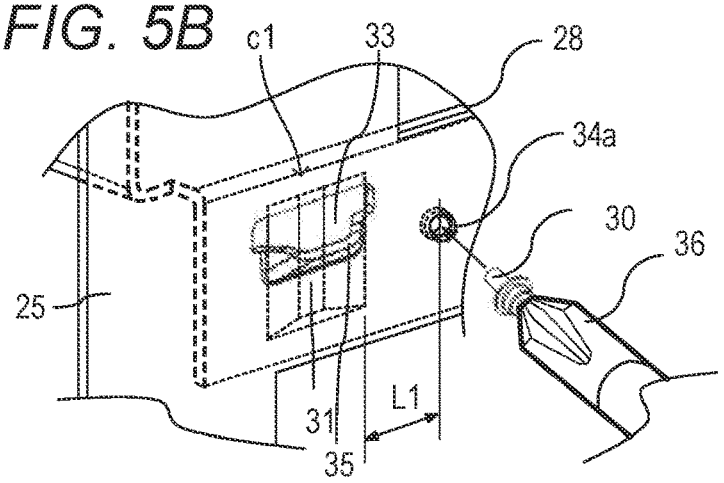
Figure 5C:
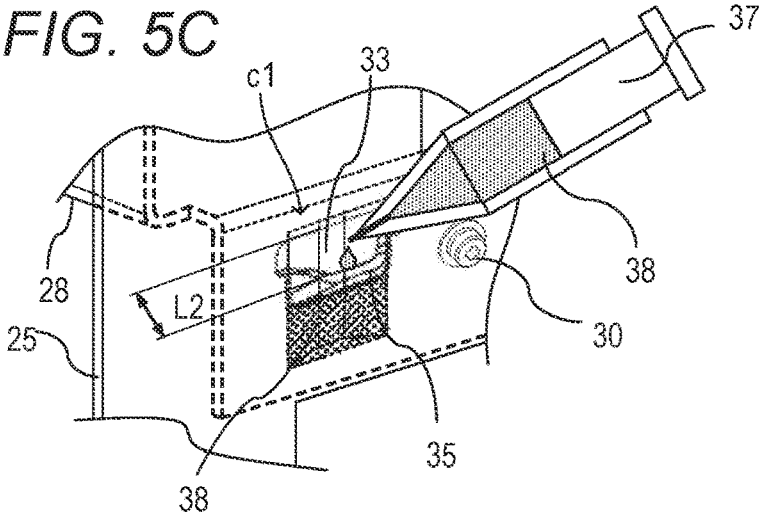

The bonding portions c1 to c8 have substantially the same structure. Thus, in the embodiment, the bonding portion c1 is described as an example. FIG. 5A, FIG. 5B, and FIG. 5C are explanatory views for illustrating an area C illustrated in FIG. 3 in an enlarged manner. FIG. 5A and FIG. 5B are explanatory views for illustrating steps of assembling the main body A, and FIG. 5C is an explanatory view for illustrating a step of injecting and applying the adhesive. FIG. 5A is a view for illustrating a state of the stay 28 and the front plate 25 before the frame of the main body A is temporarily assembled with the screws 30 as described above. A recess portion 31 that is recessed (projects) in a direction away from the front plate 25 (second metal plate) is formed at a position on the stay 28 (first metal plate), which corresponds to the bonding portion c1. Specifically, the recess portion 31 is formed on a surface of the stay 28, which is brought into contact with the front plate 25 when being fastened with the screws. A cross section of a space SP between the recess portion 31 of the stay 28 and the front plate 25, which is taken along a horizontal direction orthogonal to a vertical direction, has a trapezoidal shape (FIG. 6C). The trapezoidal shape is formed with a flat portion 31*a* of the recess portion 31 of the stay 28, a flat portion 25*a* of the front plate 25, which is opposed to the recess portion 31, and inclined portions 32 formed on both sides of the flat portion 31*a* of the recess portion 31 of the stay 28. Each of the inclined portions 32 is formed so as to connect an end portion of the flat portion 31*a* of the stay 28 (recess portion 31) and a flat surface of the front plate 25, which is brought into contact with the stay 28, to each other. The recess portion 31 is formed by half-cut drawing with the amount of recess of about 0.3 mm from the surface of the stay 28, which is brought into contact with the front plate 25. In this manner, after the stay 28 is fastened to the front plate 25 with the screws 30 to achieve the temporary assembly, the space SP into which the adhesive is to be injected is formed between the recess portion 31 formed on the stay 28 and the front plate 25.

Further, in this configuration, an opening portion 33 passing through the front plate 25 is formed at a position on the front plate 25, which is opposed to the recess portion 31 formed on the stay 28, for injection of the adhesive into the space SP surrounded by the recess portion 31 formed on the stay 28 and the front plate 25. In addition, an injection receiving portion 35 having a bell mouth shape is formed on the front plate 25 so as to be located below the opening portion 33 in the vertical direction. The injection receiving portion 35 is formed by drawing of the metal plate.

FIG. 5B is a view for illustrating a state immediately before the fastening with the screw 30 mounted to a bit 36 of a screwdriver after positioning between the front plate 25 and the stay 28 for the temporary assembly of the frame of the main body A. A screw hole 34*a* formed in the front plate 25 and a screw hole 34*b* formed in the stay 28 are screw holes through which the screw 30 passes (penetrates) when the front plate 25 and the stay 28 are fastened to each other with the screw 30. When the screw 30 is inserted into the screw holes 34*a* and 34*b* and is fastened under the state illustrated in FIG. 5B, the front plate 25 and the stay 28 are temporarily assembled to each other. As a result, as described above, the space SP between (surrounded by) the flat surface of the front plate 25 and the recess portion 31 of the stay 28 is formed. The bonding portion c2 between the stay 28 and the front plate 25 has the same structure as that of the bonding portion c1 described above.

Similarly, recess portions, each being recessed in the direction away from the front plate 25, are also formed at positions on the stay 27, which correspond to the bonding portions c3 and c4. With the formation of the recess portions, after the stay 27 is fastened to the front plate 25 with the screws 30 to achieve the temporary assembly, spaces into which the adhesive is to be injected are formed between the recess portions formed on the stay 27 and the front plate 25. In the embodiment, an opening portion is formed at a position on the front plate 25, which is opposed to each of the recess portion formed on the stay 27, so that the adhesive is injected through the opening portion into the space surrounded by the recess portion formed on the stay 27 and the front plate 25.

Besides, although not shown, recess portions recessed in a direction away from the rear plate 26 are formed at positions on the stay 28, which correspond to the bonding portions c5 and c6 (FIG. 3). Similarly, recess portions recessed in the direction away from the rear plate 26 are formed at positions on the stay 28, which correspond to the bonding portions c7 and c8. After the stay 28 is fastened to the rear plate 26 with the screws 30 to achieve the temporary assembly, spaces into which the adhesive is to be injected are formed between the recess portions formed on the stay 28 and the rear plate 26. Similarly, after the stay 27 is fastened to the rear plate 26 with the screws 30 to achieve the temporary assembly, spaces into which the adhesive is to be injected are formed between the recess portions formed on the stay 27 and the rear plate 26. In the embodiment, opening portions are formed at positions on the rear plate 26, which are opposed to the recess portions formed on the stays 27 and 28, so as to inject the adhesive into the spaces surrounded by the recess portions formed on the stays 27 and 28 and the rear plate 26.

[Bonding Stays Between Front Plate and Rear Plate]

Next, there is described a step of injecting and applying the adhesive to the above-mentioned bonding portions c1 to c8 so as to bond the stays 27 and 28 to the front plate 25 and the rear plate 26, which have been temporarily assembled with the screws 30 to form the frame of the main body A.

FIG. 5C is a view for illustrating a state in which an adhesive 38 is injected into the space between the front plate 25 and the recess portion 31, which is formed in the temporarily assembled frame of the main body A, through the opening portion 33 of the front plate 25 with use of an adhesive applicator 37, to thereby form the bonding portion c1. In the embodiment, a two-component acrylic adhesive is used as the adhesive 38. A predetermined amount of the adhesive 38 is injected into the recess portion 31 through the opening portion 33 with use of the adhesive applicator 37. Working time required to inject the adhesive 38 into one space is about several seconds, and thus the work is easy to be performed within relatively short time. A portion hatched with broken lines below the injection receiving portion 35 of FIG. 5C represents the adhesive 38 that has been injected.

An opening width L2 of the opening portion 33 in the vertical direction (distance from a vertically upper end portion of the opening portion 33 to a vertically upper end portion of the injection receiving portion 35) is about 4 mm. A distal-end nozzle of the adhesive applicator 37 is inserted into the opening portion 33 to inject the adhesive 38 into the recess portion 31 for forming the bonding portion. As a result, the adhesive 38 flows into the space SP at the bonding portion c1 formed between the recess portion 31 on the stay 38 and the front plate 25. A viscosity of a first-component adhesive and a viscosity of a second-component adhesive of the adhesive 38 to be used in the embodiment fall within a range of from about 3,000 milli-Pascal second (mPa·s) to about 10,000 milli-Pascal second (mPa·s).

The adhesive 38 injected through the opening portion 33 gradually spreads in the space SP surrounded by the recess portion 31 and the front plate 25, in particular, in portions between the inclined portions 32 formed on both sides of the flat portion 31*a* of the stay 28 and the flat portion 25*a* of the front plate 25, due to a capillary action (FIG. 6C). Further, in the embodiment, because of use of the adhesive having low viscosity, the adhesive 38 spreads from an edge portion of the recess portion 31 even into an extremely small clearance between the stay 28 and the front plate 25 to a certain range due to the capillary action. Thus, bonding strength is further increased.

In the embodiment, time of about several minutes is required until the adhesive 38 fully spreads in an entire region of the recess portion 31. Time required for the spread of the adhesive 38 after the injection and application of the adhesive 38 with use of the adhesive applicator 37 and time required for solidification do not delay execution of subsequent steps. Thus, time of a working step is not increased.

[Spread of Adhesive in Recess Portion]

Figure 6A:
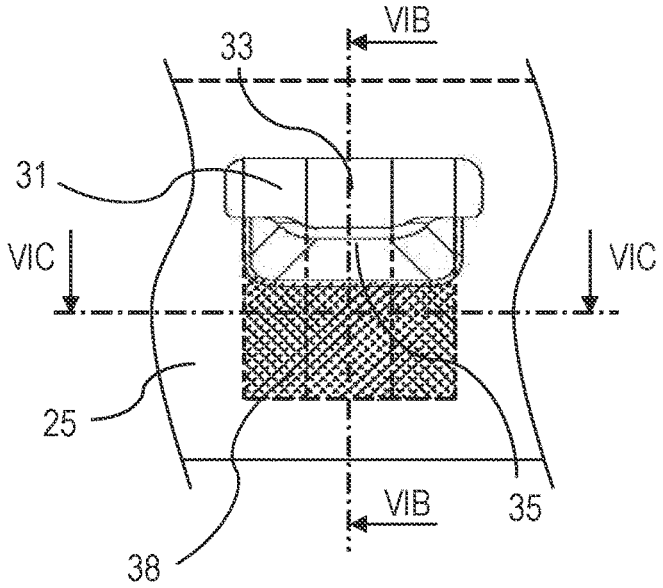
FIG. 6A, FIG. 6B, and FIG. 6C are explanatory views for illustrating a bonding portion of the image forming apparatus main body according to the embodiment.
Figure 6B:
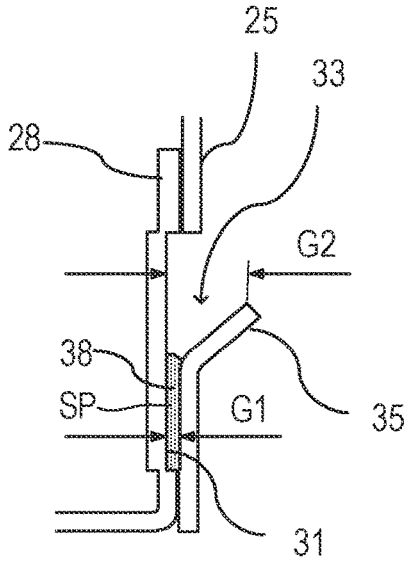
Figure 6C:
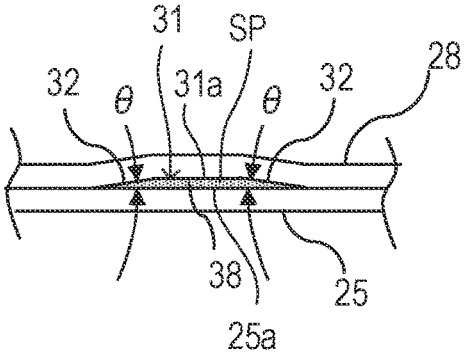

FIG. 6A, FIG. 6B, and FIG. 6C are explanatory views for illustrating the bonding portion of the image forming apparatus main body according to the embodiment. FIG. 6A is a front view when the recess portion 31 formed on the stay 28 is viewed from the front plate 25 side. FIG. 6B is a sectional view of the recess portion 31, which is taken along the line VIB-VIB of FIG. 6A. FIG. 6C is a sectional view of the recess portion 31, which is taken along the line VIC-VIC of FIG. 6A. A portion hatched with broken lines as illustrated in FIG. 6A represents the adhesive 38 injected in the space at the bonding portion, which is formed between the recess portion 31 and the front plate 25. FIG. 6B and FIG. 6C are sectional views, each for illustrating a state of the recess portion 31 after the adhesive 38 is injected under the state illustrated in FIG. 5C.

As illustrated in FIG. 6B, a gap G1 of the recess portion 31 (gap between the flat portion 31*a* of the recess portion 31 (stay 28) and the flat portion 25*a* of the front plate 25, which is opposed to the flat portion 31*a* of the recess portion 31) in the horizontal direction is set as small as about 0.3 mm. Thus, the gap G1 is formed so that even a small amount of the adhesive 38 can spread in the space at the bonding portion. Meanwhile, a gap G2 of the opening portion 33 through which the adhesive 38 is injected (gap between the flat portion 31*a* of the recess portion 31 (stay 28) and the injection receiving portion 35 (vertically upper end portion of the injection receiving portion 35)) is set to be larger than the gap G1 so as to facilitate work of injecting and applying the adhesive 38. With the above-mentioned configuration of the recess portion 31, the adhesive 38 injected through the opening portion 33 moves from the opening portion 33 into the small gap G2 at the bonding portion, which is formed between the recess portion 31 and the front plate 25, by gravity.

Further, as illustrated in FIG. 6C, each of the inclined portions 32 of the recess portion 31 has an inclination angle θ of about 5 degrees with respect to the front plate 25, which has a flat surface opposed to the inclined portions 32. Thus, the adhesive 38 is likely to spread due to the so-called capillary action in which a surface tension acts to shrink a liquid surface with respect to inclination in the vicinity of a wall surface. Further, when the inclined portions 32 are formed on the recess portion 31, a volume can be reduced as compared to that in a case in which the recess portion 31 being a region into which the adhesive 38 is to be injected has a recessed shape as a whole. As a result, the amount of use of the adhesive 38 to be injected can be reduced. Further, when the metal plate (stay 28) and the metal plate (front plate 25) are bonded to each other with a distance therebetween, the bonding strength is lowered. Thus, an effect of increasing the bonding strength is also obtained. In this manner, when the inclined portions 32 are formed on the recess portion 31, each of the bonding portions has such a structure that provides the above-mentioned effects.

Meanwhile, strength of the adhesive 38 against a force in a direction of separating the metal plates bonded via the adhesive 38 is not quite large. Thus, when the stay 28 and the front plate 25 are fastened and brought into close contact with each other with the screws 30 having large coupling strength in the separating direction, the separation of the adhesive 38 can be prevented. The screws 30 fulfill a supplementary role of preventing the separation of the stay 28 and the front plate 25 from each other. Further, the acrylic adhesive is used as the adhesive 38 of the embodiment. Thus, the stay 28 and the front plate 25 are substantially electrically isolated from each other. Accordingly, the fastening with the screws 30 having electrical conductivity has a role of electrically connecting the metal plates so as to earth the metal plate frame. There exist various types of electrically conductive adhesives. However, there exists no electrically conductive adhesive suitable for the embodiment, which meets requirements such as time required for bonding, bonding strength, and cost.

As described above, when a separation force is applied in the direction of separating the metal plates that are bonded via the adhesive to overlap with each other, the separation force is locally applied to an end portion of the adhesive. Thus, the separation at a bonding interface between the metal plates is liable to occur. Meanwhile, it is understood that strength between the metal plates coupled to each other via the adhesive in a shear direction is five to twenty times or more than shear strength achieved by the screws, specifically, a force in the shear direction, which is maintained by a frictional force generated between the metal plates that are held in contact with each other with the screws. Thus, when the metal plates are coupled to each other via the adhesive, occurrence of a phenomenon called "screw misalignment" due to an impact applied by the fastening members such as the screw can be prevented.

In the embodiment, a distance L1 (FIG. 5A) from the recess portion 31 (one end of the recess portion 31) in connection with a flat surface of the stay 28 and a screw hole 34*b* (center of the screw hole, that is, a center of a joining portion or a positioning portion, which positions the front-side assembly 125 and the bottom-plate assembly 121) in the horizontal direction is set to be equal to or smaller than 30 mm. The reason why the distance L1 is set to be equal to or smaller than 30 mm is as follows. In general, when a distance in a plane direction (flat surface direction) is equal to or smaller than 30 mm, a flatness of 0.2 mm or less can be sufficiently achieved as a flatness (degree of unevenness) of each of the metal plates. Meanwhile, when the distance in the plane direction exceeds 30 mm, the flatness of each of the metal plates becomes larger than 0.2 mm Thus, a clearance between the recess portion 31 and the front plate 25 after the fastening with the screws may be increased to result in dropping of the injected adhesive through the clearance. As a result, the injected adhesive may drop and flow down to an area for which the bonding is not required. Further, the amount of adhesive at the bonding portion may be reduced due to the dropping and the flow of the injected adhesive. Thus, there is also a fear in that desired bonding strength cannot be obtained. Accordingly, the distance L1 from the screw hole 34*b* into which the screw 30 is fastened to the recess portion 31 is set to be equal to or smaller than 30 mm. In this manner, occurrence of the above-mentioned matter is prevented. In the embodiment, even for each of the recess portions 31 for forming the bonding portions c2 to c8, a distance from the recess portion 31 to the screw hole 34*b* in the vicinity of the recess portion 31 is set in the same manner.

In addition, in the main body A according to the embodiment, the frame of the main body A has eight bonding portions c1 to c8 (FIG. 3) in total. In the bonding portions c1 to c8, the opening portions 33 for injection of the adhesive are formed on an outer side of the frame, on which the cover Aa (FIG. 1) is mounted, specifically, in the front plate 25 (second metal plate) and the rear plate 26. The opening portions 33 are arranged as described above so that the work of injecting and applying the adhesive 38 can be collectively performed for the eight bonding portions at a time in a final step of the frame assembly.

Further, in the embodiment, the fastening work with the screws 30 can be collectively performed. Hitherto, when the adhesive is used, the adhesive is applied to a member to be bonded with use of an application tool, the member to be bonded is assembled to a target member to be bonded, and then the screw fastening work is performed with use of a screw tightening tool. An action of taking and placing aside the adhesive application tool and the screw tightening tool is required to be performed each time each of the plurality of frame members is assembled, and thus this working method is not efficient.

Meanwhile, with the frame structure of the main body A according to the embodiment, after the frame is temporarily assembled with the fastening members such as the screws 30, the work of injecting and applying the adhesive 38 from the outside of the frame can be collectively performed. Thus, the action of taking and placing aside the tools such as the screw tightening tool and the adhesive application tool is not required to be repeated for several times. Thus, the work can be collectively performed to allow production with increased work efficiency.

Further, in the embodiment, the metal plates are joined to each other by applying the adhesive in the last step of manufacturing a housing structure. Thus, there is no fear of solidification of the adhesive before the adhesive is brought into contact with a target member to be bonded, which has been a concern in a working step of applying the adhesive before the assembly of the metal plates in the related art. As a result, there is no risk of a reduction in bonding strength provided by the adhesive, and tight control of the working time to prevent the solidification of the adhesive is not required.

Further, work of applying the adhesive to a vertical surface is extremely difficult because the adhesive runs down thereon. The structure according to the embodiment has excellent workability in injection of the adhesive. Further, in the work of injecting the adhesive in the embodiment, there is less liability of running of the adhesive or adhesion of the running adhesive to an area for which the bonding is not required as compared to a case in which work of applying the adhesive on two components to be assembled and then changing postures of the two components to be assembled is performed. In the embodiment, the screws made of metal are used as a unit for fastening the metal plates, that is, the stay 28 and the front plate 25, together. However, a unit or a method with electroconductivity for positioning the metal plates or for joining the metal plates to each other, such as a rivet or spot welding, may be used. In case of welding, the front-side assembly 125 and the bottom-plate assembly 121 are welded so as to be positioned to each other.

[Frame Structure of Feeding Deck and Assembly of Frame]

Figure 7:
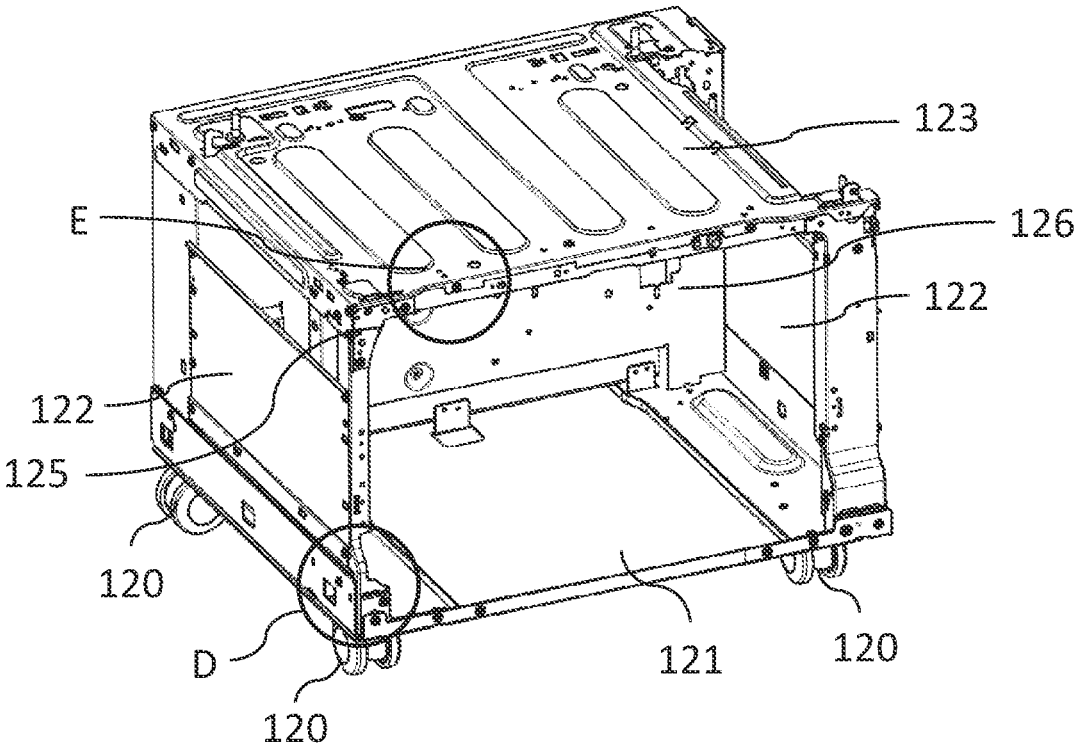
FIG. 7 is a perspective view for illustrating the frame structure of the optional feeding deck according to the embodiment.

Next, a frame structure of the feeding deck B is described. FIG. 7 is a perspective view for illustrating a frame (housing) structure of the feeding deck B. FIG. 7 is an illustration of the frame under a state in which a cover Ba configured to cover an outside of the feeding deck B illustrated in FIG. 1, members such as the sheet cassette 116, the feed rollers 117, and the conveyance rollers 118, which are installed inside the apparatus and illustrated in FIG. 2, are removed. As in the case of the above-mentioned frame of the main body A, for the frame of the feeding deck B, a housing structure is formed by connecting metal plates. The frame of the feeding deck B includes a bottom-plate assembly 121, right and left side plates 122, a top plate 123, a front-side assembly 125, and a back plate 126. The four casters 120 are mounted to the bottom portion of the bottom-plate assembly 121. In FIG. 7, areas D and E, each being surrounded by a circle, represent areas, in each of which a bonding portion of the feeding deck B described later is formed, and details thereof are described later. Also, in the feeding deck B, as in the main body A, screws are used as the units for fastening the metal plates to each other.

Figure 8:
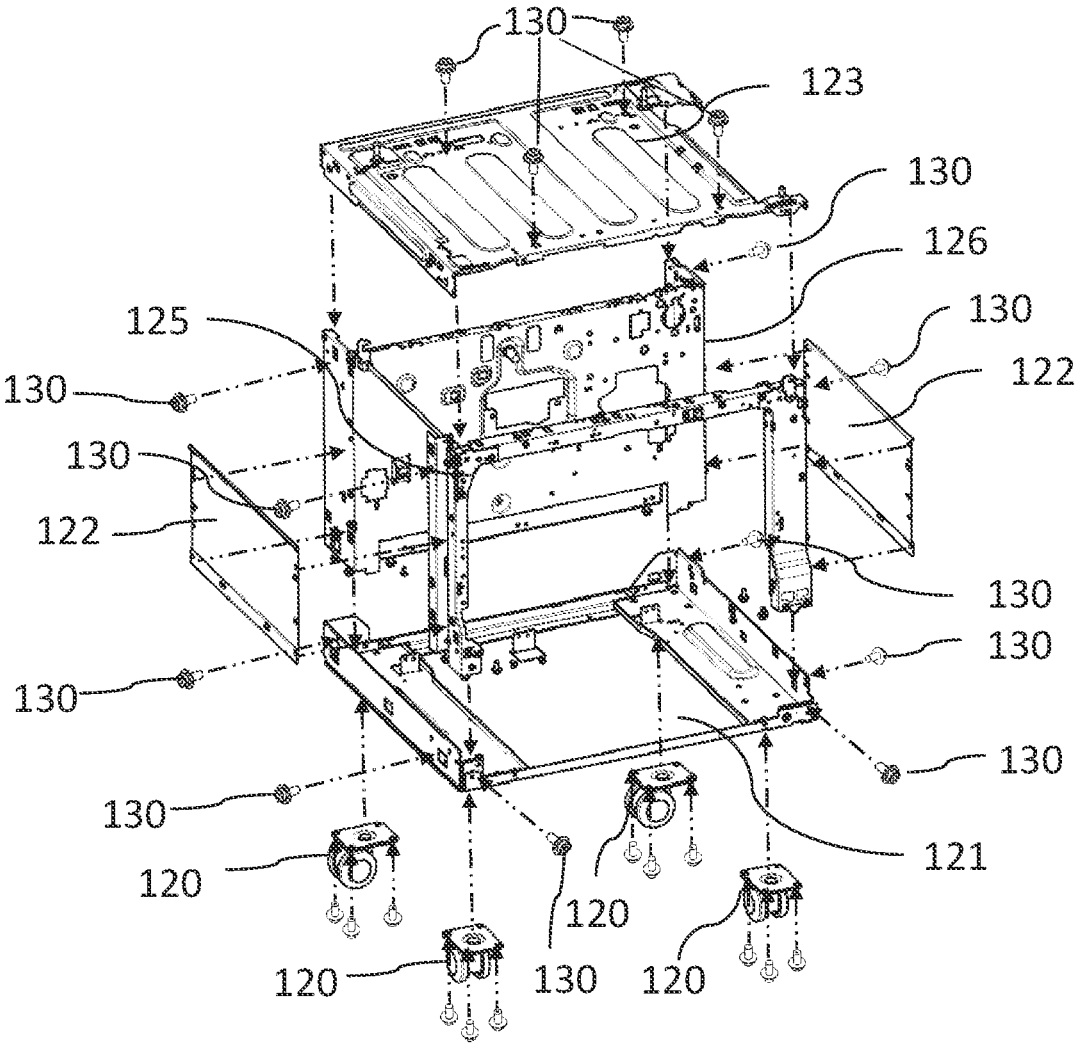
FIG. 8 is an explanatory view for illustrating assembly of a frame of the optional feeding deck according to the embodiment.

FIG. 8 is an exploded explanatory view for illustrating a way of assembling the frame of the feeding deck B, which is illustrated in FIG. 7. In a case of the feeding deck B, the bottom-plate assembly 121 and the front-side assembly 125 are first assembled to each other in advance. As an assembly order in temporary assembly, the front-side assembly 125 and the back plate 126 are brought into contact with the bottom-plate assembly 121 from above. The front-side assembly 125, the back plate 126, and the bottom-plate assembly 121 are fastened with screws 130 so as to be assembled to each other. Next, the top plate 123 is brought into contact with the front-side assembly 125 and the back plate 126 from above. The top plate 123, and front-side assembly 125 and the back plate 126 are fastened with the screws 130 so as to be assembled to each other. Finally, the side plates 122 are brought into contact with the front-side assembly 125 and the back plate 126 from right and left sides. The side plates 122, the front-side assembly 125, and the back plate 126 are fastened with the screws 130 so as to be assembled to each other. In this manner, the temporary assembly is completed. Further, the casters 120 are fastened with screws to be mounted to the bottom-plate assembly 121. Similarly, to the frame of the main body A, the adhesive is injected into the bonding portions, and is solidified in the frame that has been fastened with the screws 130 and temporarily assembled. As a result, the metal plates for forming the feeding deck B are joined to each other to thereby terminate the assembly of the frame.

[Bonding Between Bottom-Plate Assembly and Front-Side Assembly]

Figure 9A:
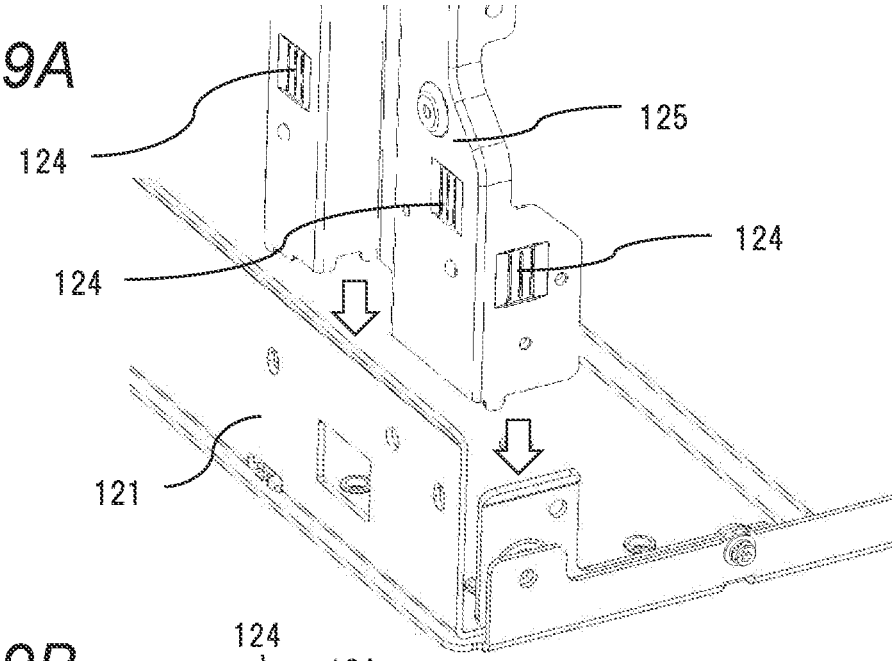
FIG. 9A, FIG. 9B, and FIG. 9C are explanatory views for illustrating the assembly of the frame of the optional feeding deck according to the embodiment.
Figure 9B:
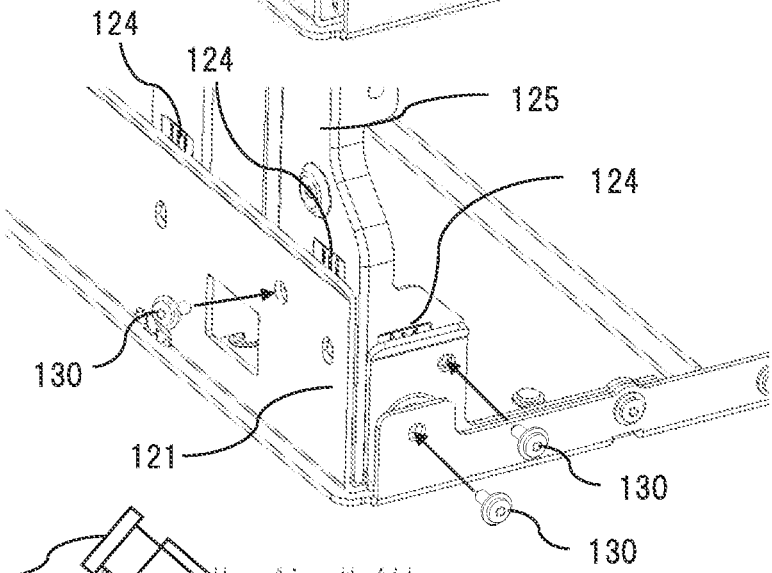
Figure 9C:
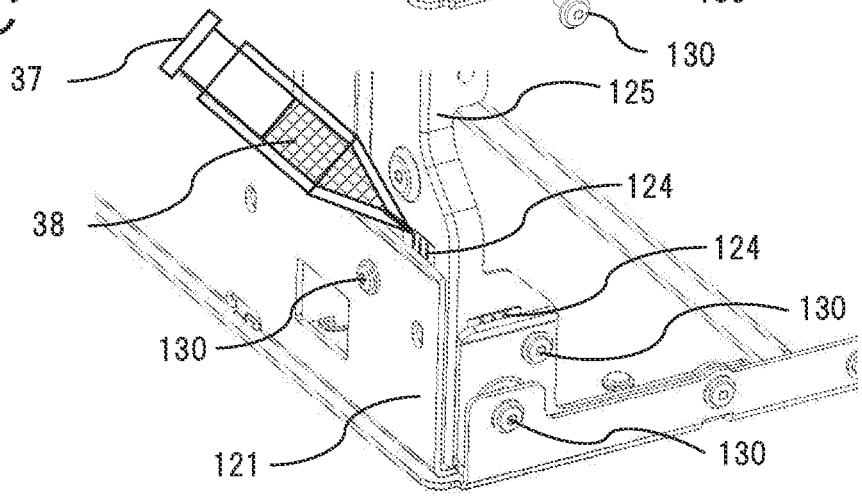

Now, a characteristic configuration of each of the bonding portions of the feeding deck B, which is different from that of each of the above-mentioned bonding portions of the frame of the main body A, is described. With reference to FIG. 9A, FIG. 9B, and FIG. 9C, a step of injecting and applying the adhesive 38 to the bonding portions so as to bond the bottom-plate assembly 121 and the front-side assembly 125, which are included in the temporarily assembled frame of the feeding deck B, is described. FIG. 9A, FIG. 9B, and FIG. 9C are views for illustrating the area D illustrated in FIG. 7 in an enlarged manner. FIG. 9A and FIG. 9B are explanatory views for illustrating steps of assembling the bottom-plate assembly 121 and the front-side assembly 125 of the feeding deck B to each other, and FIG. 9C is an explanatory view for illustrating a step of injecting and applying the adhesive 38.

Figure 10A:
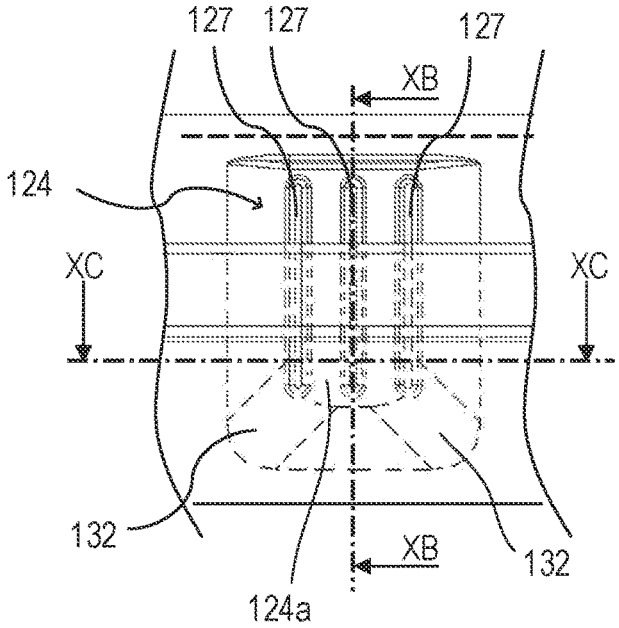
FIG. 10A, FIG. 10B, and FIG. 10C are explanatory views for illustrating a bonding portion of the optional feeding deck according to the embodiment.
Figure 10B:
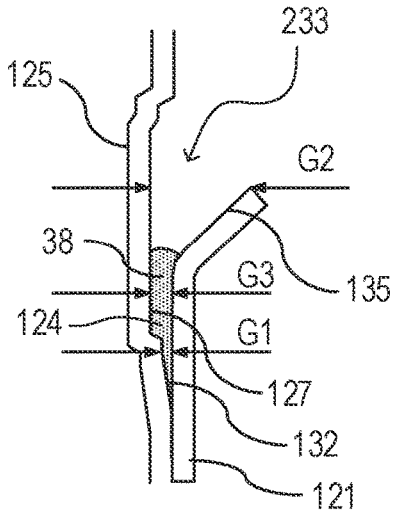
Figure 10C:
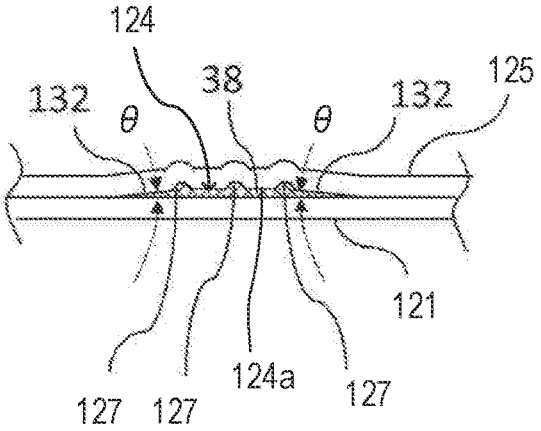

FIG. 9A is a view for illustrating a state of the bottom-plate assembly 121 and the front-side assembly 125 before the frame of the feeding deck B is temporarily assembled with the screws 130 as described above. In FIG. 9A, recess portions 124 are formed on flat surfaces of the front-side assembly 125 (first metal plate), which are to be brought into contact with the bottom-plate assembly 121 (second metal plate). On a cross section taken along the horizontal direction, each of the recess portions 124 has an opposed portion (flat portion) **124*a* of the front-side assembly 125 and an inclined portion 132. The opposed portion 124*a* is opposed to a flat portion of the bottom-plate assembly 121. The inclined portion 132 is formed on both sides of the opposed portion 124***a* of the front-side assembly 125. Three groove portions 127 (FIG. 10A, FIG. 10B, and FIG. 10C) recessed (projecting) in a direction from the bottom-plate assembly 121 toward the front-side assembly 125, which extend in a direction of extension (vertical direction) of the recess portion 124, are formed on the opposed portion 124*a* of the recess portion 124 (front-side assembly 125). Further, two of the groove portions 127, which are located on outer sides, are continuous with one end portion of the inclined portion 132 (FIG. 10A, FIG. 10B, and FIG. 10C). Further, the inclined portion 132 is inclined so that another end portion thereof is brought into contact with a flat surface of the bottom-plate assembly 121.

Meanwhile, the bottom-plate assembly 121 is configured so that, when the bottom-plate assembly 121 and the front-side assembly 125 are temporarily assembled with the screws 130, each of the recess portions 124 of the front-side assembly 125 is partially exposed from one end of the bottom-plate assembly 121 without being entirely covered (FIG. 9C). Thus, an opening portion formed by cutting the metal plate, as those formed in the main body A described above, is not formed. An upper end portion of the bottom-plate assembly 121 has an inclined surface 135 inclined in a direction away from the front-side assembly 125. The inclined surface 135 is formed so as not to become an obstacle when the adhesive 38 is injected into and applied to the recess portion 124.

FIG. 9B is a view for illustrating a state immediately before the front-side assembly 125 and the bottom-plate assembly 121 are fastened to each other with the screws 130 after the front-side assembly 125 is brought into contact with the bottom-plate assembly 121 from above (in a direction indicated by an outlined arrow of FIG. 9A) and is assembled while being slid against the bottom-plate assembly 121 under a state illustrated in FIG. 9A. When the screws 130 are inserted into screw holes to fasten the bottom-plate assembly 121 and the front-side assembly 125 together under a state illustrated in FIG. 9B, the bottom-plate assembly 121 and the front-side assembly 125 are temporarily assembled to each other. As a result, a space between (surrounded by) the flat surface of the bottom-plate assembly 121 and the recess portion 124 of the front-side assembly 125 is formed. When the temporary assembly with the screws 130 is completed, the recess portion 124 has a shape recessed (projecting) in a direction away from the bottom-plate assembly 121. Further, as illustrated in FIG. 9B, a vertically upper end portion of each of the recess portions 124 formed on the front-side assembly 125 is located at a position higher than an upper end portion of the bottom-plate assembly 121 that has been temporarily assembled, and is in an open state. Thus, unlike the main body A described above, an opening portion for injection of the adhesive to the bonding portion is not formed.

FIG. 9C is a view for illustrating a state in which the adhesive 38 is injected with use of the adhesive applicator 37 into the recess portion 124 of the front-side assembly 125 from above the upper end portion of the bottom-plate assembly 121 of the feeding deck B that has been temporarily assembled, in the same manner as the above-mentioned injection and application of the adhesive in the main body A. Hitherto, when the adhesive is applied in advance to an area in which the metal plates are held in close contact with each other with little clearance therebetween as illustrated in FIG. 9A so as to bond the metal plates, the following matter may arise. Specifically, the adhesive that has been applied in advance may be scraped off at the time of assembly to fail to provide desired bonding strength, or the frames may be rubbed against each other at the time of the assembly work to scrape off the adhesive to result in adhesion of the adhesive to an area for which the bonding is not required.

Meanwhile, in the embodiment, as described above, the metal plate (bottom-plate assembly 121) and the metal plate (front-side assembly 125) are assembled to each other by the fastening with the screws 130 in the plane direction without forming little clearance. Thus, in the above-mentioned configuration, after the temporary assembly, the adhesive 38 can be injected and applied to the above-mentioned bonding portions. This configuration allows necessary coupling strength to be obtained without causing the above-mentioned matters such as the adhesion of the adhesive to an area for which the bonding is not required.

[Spread of Adhesive in Recess Portion]

FIG. 10A, FIG. 10B, and FIG. 10C are explanatory views for illustrating the bonding portion of the feeding deck B according to the embodiment. FIG. 10A is a front view when the recess portion 124 formed on the front-side assembly 125 is viewed from the bottom-plate assembly 121 side. FIG. 10B is a sectional view of the recess portion 124, which is taken along the line XB-XB of FIG. 10A. FIG. 10C is a sectional view of the recess portion 124, which is taken along the line XC-XC of FIG. 10A. FIG. 10B and FIG. 10C are sectional views, each for illustrating a state of the recess portion 124 after the adhesive 38 is injected under the state illustrated in FIG. 9C.

As illustrated in FIG. 10B, the vertically upper end portion of the bottom-plate assembly 121 is formed to have the inclined surface 135 inclined in the direction away from the front-side assembly 125 fastened with the screws 130. An opening portion 233 is formed between the inclined surface 135 and the front-side assembly 125. Specifically, the recess portion 124 has the inclined portion (inclined surface) 132. The inclined portion 132 is inclined so as to bring a vertically lower end portion of the opposed portion 124*a* of the recess portion 124 into contact with a portion of the bottom-plate assembly 121, which is opposed to the opposed portion 124*a* of the recess portion 124, and bring one horizontal end of the opposed portion 124*a* of the recess portion 124 into contact with the portion of the bottom-plate assembly 121, which is opposed to the opposed portion 124*a* of the recess portion 124. More specifically, as illustrated in FIG. 10C, the inclined portion 132, which is formed to extend from horizontal ends of the groove portions 127 of the recess portion 124, is formed to have the inclination angle θ with respect to the bottom-plate assembly 121 having the flat surface opposed thereto.

Further, vertically lower end portions of the groove portions 127, which are formed on the recess portion 124 of the front-side assembly 125, are in connection with the inclined portion 132, each having the inclination. When the adhesive 38 that has been injected flows down into the recess portion 124, the adhesive 38 flows and spreads into the recess portion 124 over time because the gap (clearance) G1 between the recess portion 124 and the bottom-plate assembly 121 is small. Meanwhile, a gap G3 between the groove portion 127 and the bottom-plate assembly 121 is larger than the gap G1. Thus, the adhesive 38 injected into the recess portion 124 can reach the inclined portion 132 within short time, and the spread of the adhesive 38 in a gravity direction is accelerated. The bonding strength can be increased as the gap G1 is reduced in size and a bonding area is increased. However, a degree of spread of the adhesive 38 in the gravity direction (vertical direction) has a tradeoff relationship with narrowness of the gap G1. Thus, the above-mentioned matter can be addressed by forming the groove portions 127.

The above-mentioned configuration of the bonding portion to which the adhesive 38 is injected and applied is also used for the vicinity of each of screw-fastened portions on the right and left side plates 122 of the frame of the optional feeding deck B and vertical mounting surfaces of the top plate 123, which are to be bonded to the back plate 126 and the front-side assembly 125.

[Bonding between Top Plate and Vertical Surfaces of Front-Side Assembly]

Figure 11:
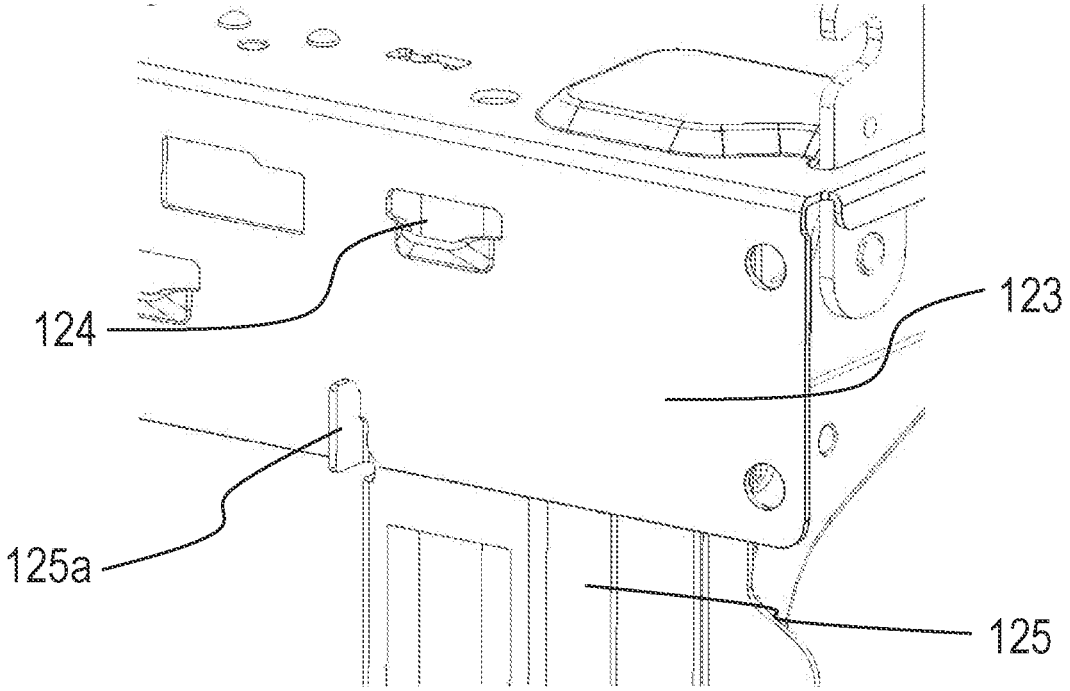
FIG. 11 is a perspective view for illustrating the frame structure in the vicinity of the bonding portion of the optional feeding deck according to the embodiment.

FIG. 11 is a view for illustrating a state in which the top plate 123 is assembled to the front-side assembly 125. In the embodiment, a bent portion of the top plate 123 is held between a hook portion 125*a* formed by bending upward a portion of the metal plate of the front-side assembly 125 and a side surface of the front-side assembly 125. This configuration is used as an alternative configuration for a screw for bringing the bent portion of the top plate 123 and the side surface of the front-side assembly 125 into close contact with each other. The configuration described above prevents the dropping of the adhesive 38 injected into a bonding portion formed between the recess portion 124 of the front-side assembly 125 and the top plate 123. The configuration described above does not use the screws 130, and thus is excellent in reduction of working time at the time of assembly of the frame and reduction of component cost.

[Bonding Between Top Plate and Horizontal Surfaces of Front-Side Assembly]

Figure 12A:
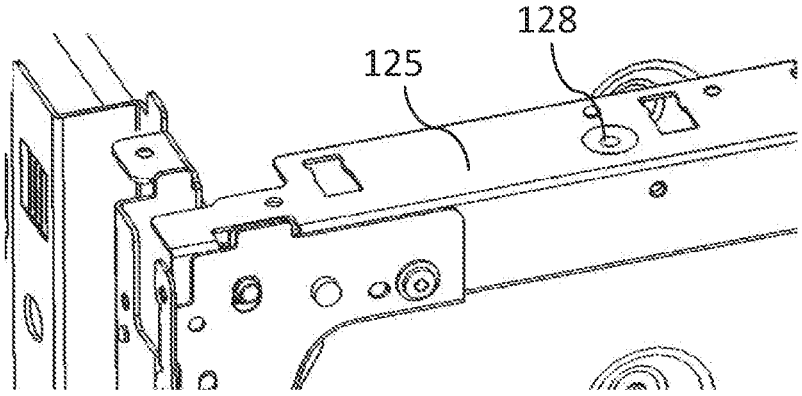
FIG. 12A, FIG. 12B, and FIG. 12C are explanatory views for illustrating assembly of a top panel of the optional feeding deck according to the embodiment.
Figure 12B:
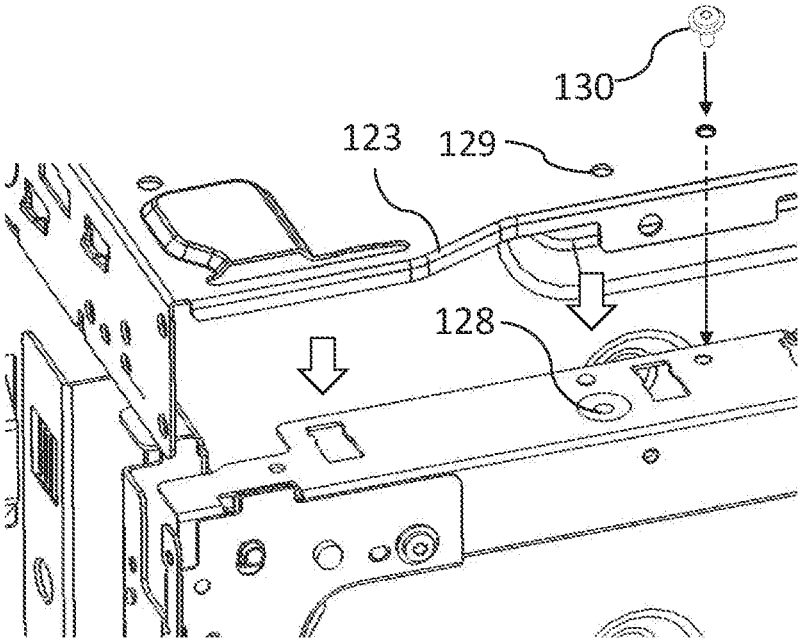
Figure 12C:
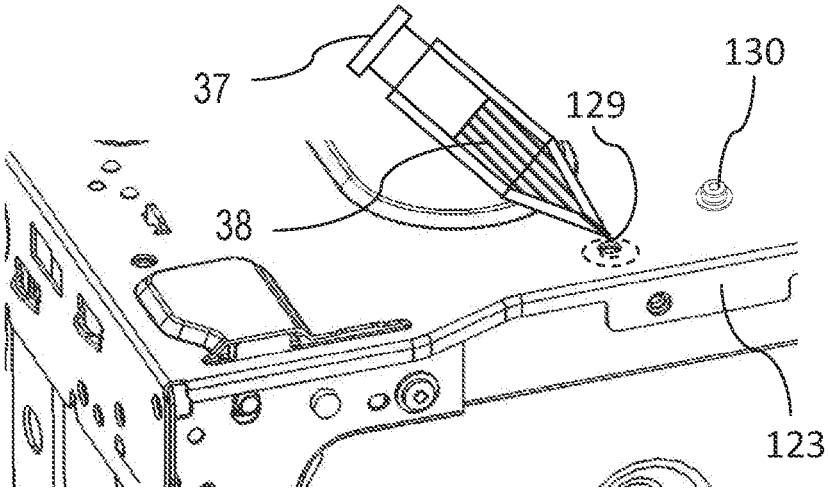

Next, with reference to FIG. 12A, FIG. 12B, and FIG. 12C, there is described a step of injecting and applying the adhesive 38 to the bonding portion so as to bond the top panel 123 and horizontal surfaces of the front-side assembly 125, which form the temporarily assembled frame of the feeding deck B. FIG. 12A, FIG. 12B, and FIG. 12C are views for illustrating the area E illustrated in FIG. 7 in an enlarged manner. FIG. 12A is an explanatory view for illustrating a configuration of the front-side assembly 125 of the feeding deck B. FIG. 12B is an explanatory view for illustrating a step of assembling the top plate 123 and the front-side assembly 125 to each other. FIG. 12C is an explanatory view for illustrating a step of injecting and applying the adhesive 38.

FIG. 12A is a view for illustrating a configuration of a surface of the front-side assembly 125, which is opposed to the top plate 123. A recess portion 128 having a conical shape, into which the adhesive 38 is to be injected and applied, is formed on the surface of the front-side assembly 125 (first metal plate), which is opposed to the top plate 123 (second metal plate), for bonding to the top plate 123. The conical shape in the specification includes a substantially conical shape, which has an opening portion of the recess portion 128 as a circular base and projects toward the top plate 123, and also includes a shape having a flat surface at an apex as illustrated in FIG. 12B. The recess portion 128 has the conical shape in the embodiment. However, the recess portion 128 may have a polygonal pyramid shape. Similarly, the polygonal pyramid shape in the specification includes a substantially polygonal pyramid shape, which has the opening portion of the recess portion 128 as a polygonal base and projects toward the top plate 123, and also includes a shape having a flat surface at an apex.

FIG. 12B is a view for illustrating a state of the top plate 123 and the front-side assembly 125 before the frame of the feeding deck B is temporarily assembled with the screws 130. Under the state illustrated in FIG. 12B, the top plate 123 is brought into contact with the front-side assembly 125 from above (in a direction indicated by an outlined arrow of FIG. 12B) so as to be assembled to the front-side assembly 125. The screw 130 is inserted into a screw hole to fasten the top plate 123 and the front-side assembly 125 together. In this manner, the top plate 123 and the front-side assembly 125 are temporarily assembled to each other. As a result of the temporary assembly with the screws 130, a bonding portion is formed with a flat surface of the top plate 123, a flat surface of the front-side assembly 125, and the recess portion 128 of the front-side assembly 125 which form (surround) a space. A hole portion 129 corresponding to an opening portion of the top plate 123 is a hole for injection of the adhesive 38 into the recess portion 128 of the front-side assembly 125, which forms the bonding portion.

FIG. 12C is a view for illustrating a state in which the adhesive 38 is injected with use of the adhesive applicator 37 into the recess portion 128 of the front-side assembly 125 through the hole portion 129 of the top plate 123 of the feeding deck B that has been temporarily assembled. A back surface of the top plate 123 and the front-side assembly 125 are bonded to each other via the adhesive 38 that has been injected. In this manner, a bonding step after the temporary assembly of the metal plates (top plate 123 and front-side assembly 125) at the horizontal surfaces can be carried out.

[Spread of Adhesive in Recess Portion]

Figure 13A:
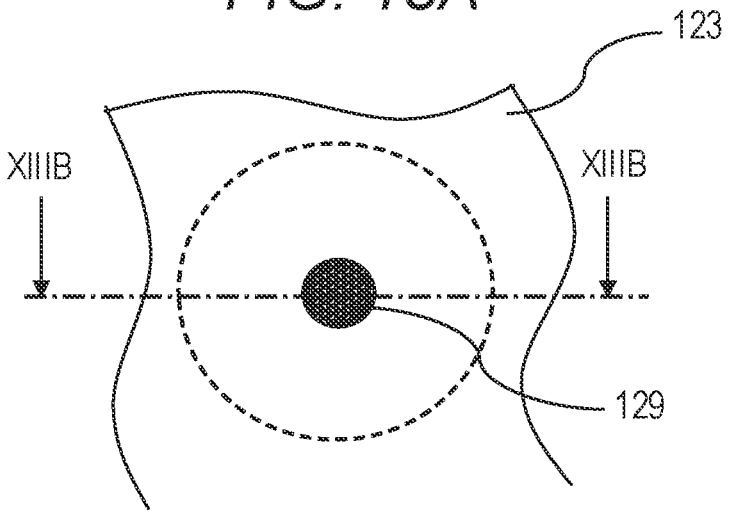
FIG. 13A and FIG. 13B are explanatory views for illustrating a bonding portion for the top panel of the optional feeding deck according to the embodiment.
Figure 13B:
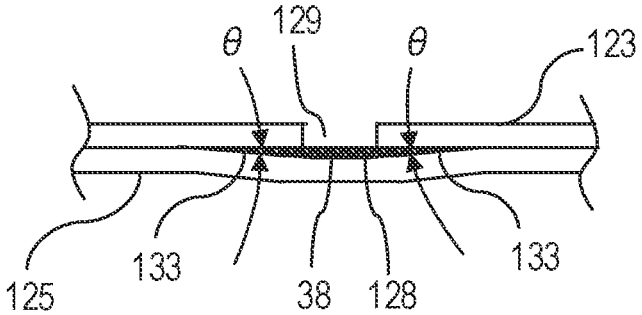

FIGS. 13A and 13B are explanatory views for illustrating the bonding portion for the top plate 123 of the feeding deck B according to the embodiment. FIG. 13A is a front view when the recess portion 128 formed on the front-side assembly 125 is viewed in a direction in which the hole portion 129 of the top plate 123 passes. FIG. 13B is a sectional view of the recess portion 128, which is taken along the line XIIIB-XIIIB of FIG. 13A. FIG. 13B is a sectional view for illustrating a state of the recess portion 128 after the adhesive 38 is injected under the state illustrated in FIG. 12C.

In FIG. 13A, a hatched portion of the hole portion 129 of the top plate 123 represents the adhesive 38 injected into the recess portion 128 of the front-side assembly 125. A circle indicated by a broken line represents an outer peripheral portion of the recess portion 128 of the front-side assembly 125. The hole portion 129, which corresponds to an opening portion serving as an injection port for the adhesive 38, is a round hole having a diameter of about 4 mm, which is formed at a position opposed to a central portion of the recess portion 128. The hole portion 129 has such a size that allows insertion of a distal end portion of the adhesive applicator 37.

Further, as illustrated in FIG. 13B, the recess portion 128 is a recess portion having a conical shape with an inclined surface 133. The inclined surface 133 is formed in a circumferential direction so as to extend in a conical manner from a center of the recess portion 128 with the inclination angle θ of about 5 degrees. The adhesive 38 that has been injected and applied through the hole portion 129 spreads inside the recess portion 128 in the circumferential direction along the inclined surface 133 due to the capillary action.

In the embodiment, there have been described the frame structure of the main body A and the frame structure of the feeding deck B, which allow the adhesive to be injected from an outside of the frames in a post-step under a state in which the frame of the image forming apparatus is temporarily assembled with, for example, the screws. The frame structures of the embodiment are applicable to a frame for other optional devices associated with the image forming apparatus or an image reading apparatus and a frame for a sheet discharge apparatus or a post-processing apparatus, and the same effects as those described above can be obtained thereby. Further, in the embodiment, there has been described the example in which a two-component adhesive is used as the adhesive. However, even when a one-component adhesive is used, the same effects can be obtained.

As described above, according to the embodiment, the housing of the image forming apparatus can easily and efficiently be formed by adhering with the adhesive.

According to the disclosure, an image forming apparatus or an optional device may include a frame that is easily and efficiently formed by adhering with an adhesive.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random access memory (RAM), a read-only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

What is claimed is:

1. An image forming apparatus comprising:

an image forming unit configured to form an image on a sheet;

a first metal plate and a second metal plate provided to sandwich the image forming unit; and a third metal plate provided between the first metal plate and the second metal plate, wherein the first metal plate and the third metal plate are fixed to each other by (1) at least one of a screw, a rivet, and a welding, and (2) an adhesive.

2. The image forming apparatus according to claim 1, wherein an opening portion is formed in the first metal plate, and the third metal plate has a recess portion, wherein the first metal plate and the third metal plate are fixed to each other by the adhesive that is in a space between the recess portion and the first metal plate in a horizontal direction, and wherein the opening portion is formed at an upper position than the space in a vertical direction.

3. The image forming apparatus according to claim 2, wherein, when viewed in a direction perpendicular to a surface of the first metal plate, the opening portion and the recess portion partially overlap.

4. The image forming apparatus according to claim 2, wherein the first metal plate is provided with an injection receiving portion configured to receive injected adhesive, and wherein a gap between the recess portion and an upper end portion of the injection receiving portion is larger than a gap between the recess portion and a lower end portion of the injection receiving portion.

5. The image forming apparatus according to claim 1, wherein the third metal plate has a recess portion, wherein, when viewed in a direction perpendicular to a surface of the first metal plate, a first part of the recess portion overlaps the first metal plate and a second part of the recess portion exposes from an edge of the first metal plate, and wherein the first metal plate and the third metal plate are fixed to each other by the adhesive that is in a space between the recess portion and the first metal plate in a horizontal direction.

6. The image forming apparatus according to claim 5, wherein the edge of the first metal plate is an inclined portion inclined in a direction away from a surface of the third metal plate.

7. The image forming apparatus according to claim 1, wherein the first metal plate and the third metal plate are fixed to each other by inserting the screw in a direction perpendicular to a surface of the first metal plate.

8. A sheet conveyance apparatus comprising:

a conveyance unit configured to convey a sheet;

a first metal plate and a second metal plate provided to sandwich the conveyance unit; and a third metal plate provided between the first metal plate and the second metal plate, wherein the first metal plate and the third metal plate are fixed to each other by (1) at least one of a screw, a rivet, and a welding, and (2) an adhesive.

9. The sheet conveyance apparatus according to claim 8, wherein an opening portion is formed in the first metal plate, and the third metal plate has a recess portion, wherein the first metal plate and the third metal plate are fixed to each other by the adhesive that is in a space between the recess portion and the first metal plate in a horizontal direction, and wherein the opening portion is formed at an upper position than the space in a vertical direction.

10. The sheet conveyance apparatus according to claim 9, wherein, when viewed in a direction perpendicular to a surface of the first metal plate, the opening portion and the recess portion partially overlap.

11. The sheet conveyance apparatus according to claim 9, wherein the first metal plate is provided with an injection receiving portion configured to receive injected adhesive, and wherein a gap between the recess portion and an upper end portion of the injection receiving portion is larger than a gap between the recess portion and a lower end portion of the injection receiving portion.

12. The sheet conveyance apparatus according to claim 8, wherein the third metal plate has a recess portion, wherein, when viewed in a direction perpendicular to a surface of the first metal plate, a first part of the recess portion overlaps the first metal plate and a second part of the recess portion exposes from an edge of the first metal plate, and wherein the first metal plate and the third metal plate are fixed to each other by the adhesive that is in a space between the recess portion and the first metal plate in a horizontal direction.

13. The sheet conveyance apparatus according to claim 12, wherein the edge of the first metal plate is an inclined portion inclined in a direction away from a surface of the third metal plate.

14. The sheet conveyance apparatus according to claim 8, wherein the first metal plate and the third metal plate are fixed to each other by inserting the screw in a direction perpendicular to a surface of the first metal plate.

* * * * *